US005377411A

United States Patent [19]

Andriotis

[11] Patent Number: 5,377,411

[45] Date of Patent: Jan. 3, 1995

[54] HAIR CUTTING APPLIANCE

[76] Inventor: Demetrios Andriotis, 19 Alden Ave., Trumbull, Conn. 06611

[21] Appl. No.: 84,147

[22] Filed: Jul. 1, 1993

[51] Int. Cl.[6] ..... B26B 19/44; B26B 19/20

[52] U.S. Cl. ..... 30/133; 30/245; 30/253

[58] Field of Search ..... 30/133, 131, 132, 245, 30/272.1, 279.2, 253

[56] References Cited

U.S. PATENT DOCUMENTS

| | | | |
|---|---|---|---|
| 960,540 | 6/1910 | Guest | 30/245 |
| 1,467,262 | 9/1923 | Barker | 30/245 X |
| 2,516,946 | 8/1950 | Barone | 30/245 |
| 3,893,237 | 7/1975 | Jahnke | 30/245 X |
| 4,077,122 | 3/1978 | Roller, Jr. et al. | 30/133 |
| 4,188,720 | 2/1980 | Korf | 30/133 |
| 4,261,102 | 4/1981 | Andriotis | 30/133 |
| 4,573,267 | 3/1986 | Grohoski et al. | 30/133 |
| 4,679,322 | 7/1987 | Hunts | 30/133 |
| 5,088,199 | 2/1992 | Romani | 30/133 |
| 5,142,786 | 9/1992 | Hunts | 30/133 |

*Primary Examiner*—Rinaldi I. Rada
*Assistant Examiner*—Clark F. Dexter
*Attorney, Agent, or Firm*—Charles R. Miranda

[57] ABSTRACT

A haircutting appliance comprises an enclosed housing having a hollow handle connecting the housing to a vacuum source to carry away cut hairs from a subject's head. A manually operated or finger depressible member is pivotally mounted on the handle in a manner that the same hand of the user which holds or grips the handle can also operate the finger depressible member which permits the other hand of the user to be free for other purposes.

A motion transmitting mechanism is located in the housing of the appliance and interconnects the finger depressible member with the cutting scissor blades. The finger depressible member is connected to a slidable plate in the housing which is provided with structure to actuate the haircutters for severing hair entering the housing. Hair spacers are carried by the housing to selectively determine the length of hair to be cut. The appliance also is constructed to readily adapt it to cut and trim by use of an electric hair clipper, short hairs of a subject's head after long hairs are cut. Readily detachable parts of the appliance are removable to permit attachment of the electric hair clipper to the housing to thereby utilize the appliance for cutting of short hairs as well as the longer hairs of a subject to complete the barbering process.

8 Claims, 4 Drawing Sheets

HAIR CUTTING APPLIANCE

BACKGROUND OF THE INVENTION

This invention relates to a haircutting appliance and more particularly to those appliances which are connected to vacuum sources to carry away hairs of a subject cut by the appliance.

Vacuum connected haircutting appliances have been favored by consumers as well as by barbers, for many reasons, one of which is that such appliances provide a clean and efficient way of cutting and disposing of cut hairs. Since many, if not most, homes and shops have vacuum cleaners such haircutting appliances are readily utilizable in many places. There are a significant number of prior art vacuum connected haircutting appliances, but they have not been commercially successful. Among other reasons is that the appliances are difficult to use, or they do not operate efficiently or the complexity of the appliance make the cost of producing same beyond an acceptable price for many consumers, or the maintenance of the appliance discourages use after the initial purchase.

Some of the prior art appliances are found in U.S. Patents set forth in the present applicant's prior U.S. Pat. No. 4,261,102 which discloses and claims a haircutting appliance connected to a vacuum source. Applicant's prior patent utilizes scissor blades or shears which are actuated to cut hairs by a pair of solenoids connected to an electrical source. An electric switch is provided on the handle of the appliance to energize the solenoids to effect the movement of the scissor blades to cut hair entering the haircutting compartment.

SUMMARY OF THE INVENTION

It is an object of the present invention to provide a novel haircutting appliance which is simple to operate, is easily maintained, and is inexpensive to produce.

Another object is to provide a haircutting appliance which is completely operable by and from one hand of the user.

Still another object is to provide a haircutting appliance which is substantially mechanical in nature, in terms of actuating a haircutting mechanism of the appliance.

A still further object is to provide a haircutting appliance which has structure readily adapting the appliance to trimming short hairs after the longer hairs of a subject have been cut to complete the barbering operation.

The haircutting appliance of the present invention comprises a housing connected to a vacuum source through a hollow handle. The handle is held by a user in cutting the hair of the subject, which in the present application is described principally for cutting the hair of a person's head although the present invention is well applicable to the cutting or shearing the hairs of animals. A manually operable or finger depressible member is pivotally mounted on the handle in a manner to permit operation by the same hand of the user gripping the handle to manipulate the same in regard to a subject's head. The finger depressible member is bifurcated to form a pair of legs which straddle the handle and the ends of the legs project into the housing. A motion transmitting mechanism is located within the housing and includes a slidable plate which is normally biased in one direction. The slidable plate has a pair of recesses therein to accommodate and engage the legs of the member, whereby depression of the finger depressible member causes movement of the slidable plate in a direction opposite to that in which the plate normally is biased. The plate has a pair of openings or slots formed therein which are disposed to converge towards each other in one direction and in the other direction to diverge away. A pair of scissor blades are provided in the housing and each blade has a stud projecting therefrom which rides in a respective slot of the sliding plate. Movement of the slidable plate operates the scissor blades. The studs are cammed by the slot configuration and the angular disposition of the slots so that actuation of the finger depressible member on the appliance handle effects the movement of the scissor blades to cut hair which is in the path of movement of the scissor blades. The cut hairs in the housing are carried away through the handle for collection in a vacuum source such as a vacuum cleaner. The housing has an opening through which the hair f the subject enters the compartment and spacer means are carried by the housing within the opening to effect a cutting of hair to certain desired lengths. In the haircutting process often times it is desired to trim the short hairs along the hairline on the neck portion of the individual and an electric hair clipper is used for that purpose with the appliance. The present invention provides a structure wherein by simple removal of certain parts, a conventional hair clipper may be attached to the structure of the appliance which then can be utilized to clip or cut the short hairs along the neckline.

DESCRIPTION OF THE PREFERRED EMBODIMENT

Figure 1:
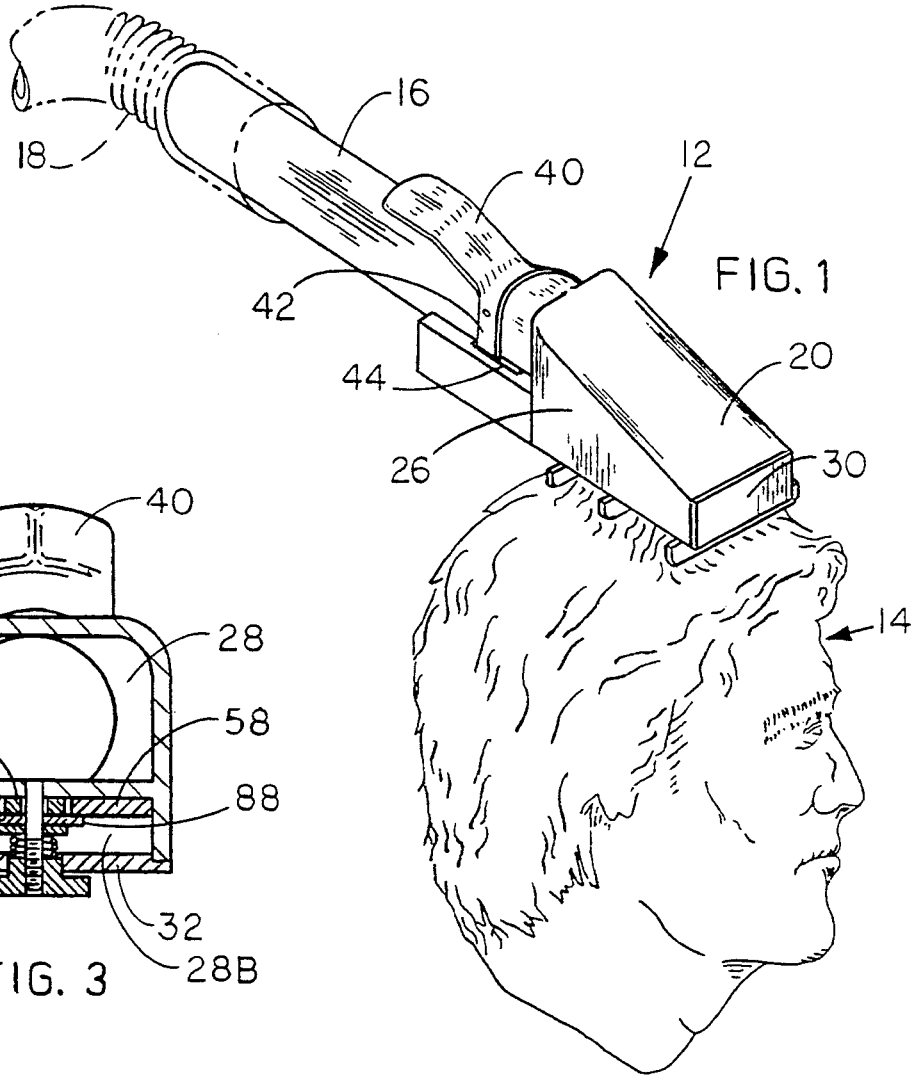
FIG. 1 is a perspective view, of the haircutting appliance of the present invention as applied to the head of a subject.
Figure 3:
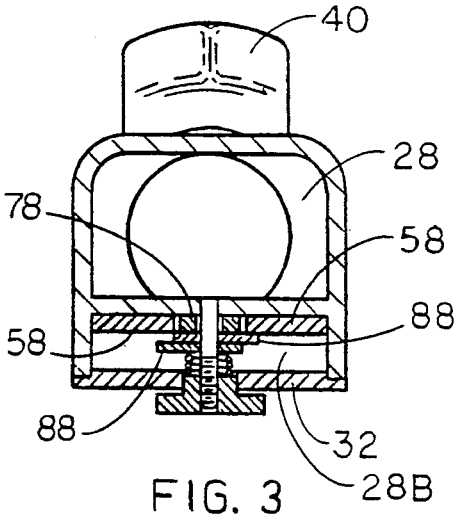
FIG. 3 is a cross sectional view of the haircutting appliance taken along the line 3—3 of FIG. 2.

Referring now to the drawings, and more particularly to FIG. 1 hereof, reference character 12 generally designates the haircutting appliance of the present invention as applied to the subject's head 14.

Appliance 12 has a hollow handle 16 having an end connected to a hose 18, shown in FIG. 1 in broken lines, connected to a vacuum source (not shown) which may be an electric vacuum cleaner found in most households and barber shops. As may be well understood, electric vacuum cleaners have a collection bag and in the present application this would be used to collect the hairs. The other end of handle 16 is connected to a housing 20 which has a slanting top wall 22 and a pair of depending side walls 24 and 26. Housing 20 has an end wall 28 to which an end of handle 16 is connected and a second end wall 30 which is removable. A bottom wall 32 closes off the lower portion of housing 20 and is provided with an opening 34, which as well be explained hereinafter permits entry of hair into the housing 20. End wall 28 comprises an upper portion 28-A and a lower portion 28-B. Projecting at right angles to lower portion 28-B into the housing 20 is an interior wall 36.

A manually operable or finger depressible member 40 (FIG. 1) is pivotally mounted on handle 16 and has a pair of depending legs 42, one seen in FIG. 1, which straddles handle 16. The ends of legs 42 project through slots 44 formed in top wall 36 of cutting compartment 22. A motion transmitting mechanism generally designated by the reference character 50 FIG. 4 comprises a slidable plate 52 which has recesses 54 formed in the sides thereof and the end of legs 42 are accommodated therein. One end of plate 52 has a V-shaped notch 56 formed therein and the other end of the plate is provided with a pair of spaced legs 58. Disposed between legs 58 is a spring retaining rod 60 which holds or retains ends 62 and 63 of a pair of coiled springs 64 and 66, respectively. The other ends 68 & 70 of springs 64 & 66 are retained by a second and parallel spring retaining rod 72 which is mounted in side walls 24 and 26 of housing 20. Disposed between legs 58 of plate 52 is an insert 78 which has a thickness dimension the same as plate 52. An opening 80 is formed in insert 78 to accommodate therein a pin 82 which has a threaded portion 84 and an un-threaded end secured within wall 36 of housing 20.

A scissors 86 having a pair of blades 88 is arranged within housing 20 and includes an opening 90 through which pin 82 extends to provide pivotal movement of blades 88. A coil spring 92 fits around threaded portion 84 of pin 82 and is compressed by a knurled nut 94 to press scissor blades 88 against slidable plate 52. Nut 94 also serves to secure bottom wall 32 to the housing 20 and in engagement with the end walls thereof. A projecting stud 96 is provided along an edge of each of the blades 88, as better seen in FIG. 4, and the studs ride within a pair of slots 98 formed in plate 52. Slots 98 converge in the direction of legs 58 of plate 52 and diverge in the other direction toward the v-shaped notch 56. Plate 52 is constrained to slide within housing 20 insofar as the edges in which recess 54 are formed, to engage the side walls 74 of housing 20.

Figure 4:
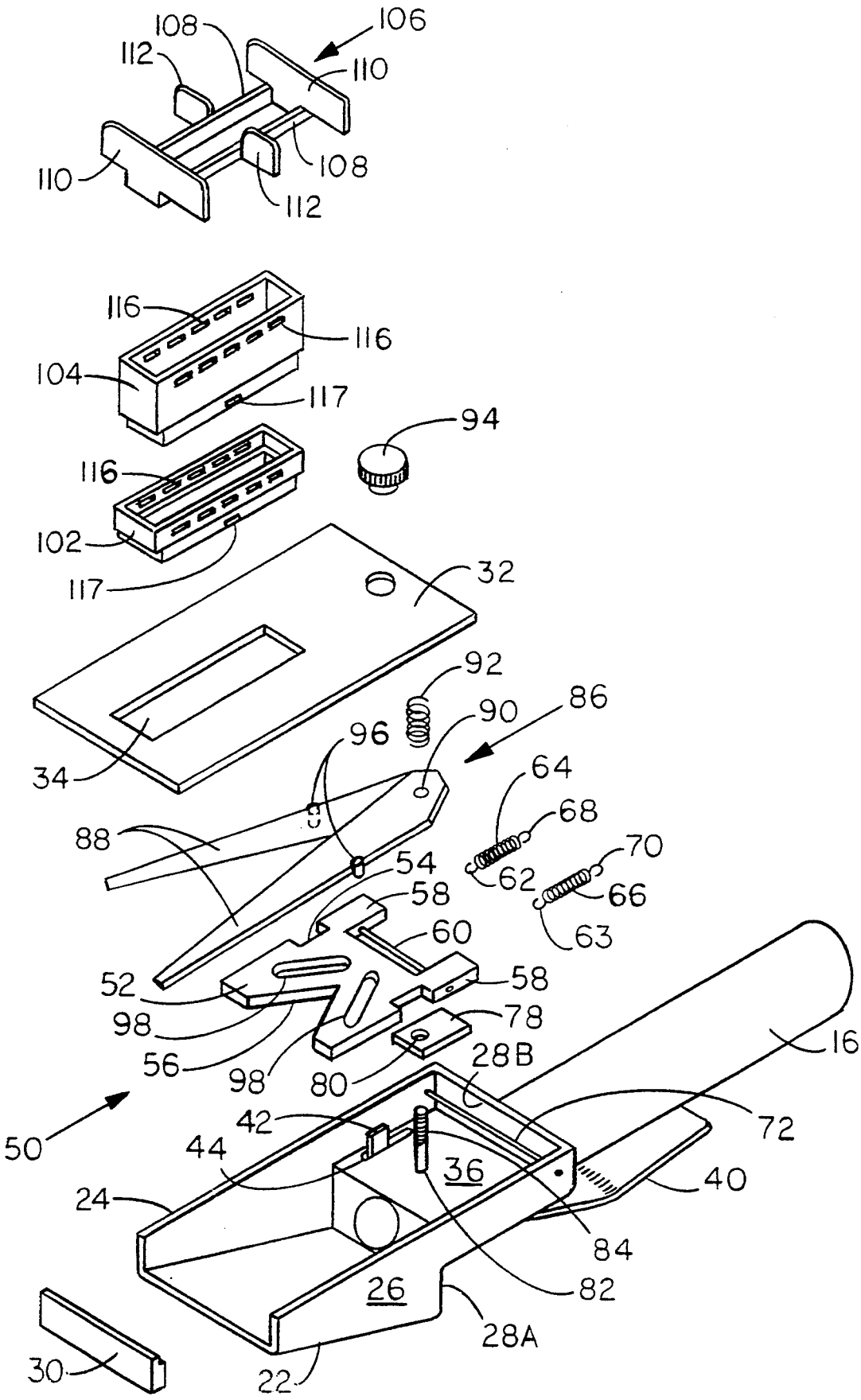
FIG. 4 is an exploded view in perspective, of the components of the appliance of FIG. 1.
Figure 6:
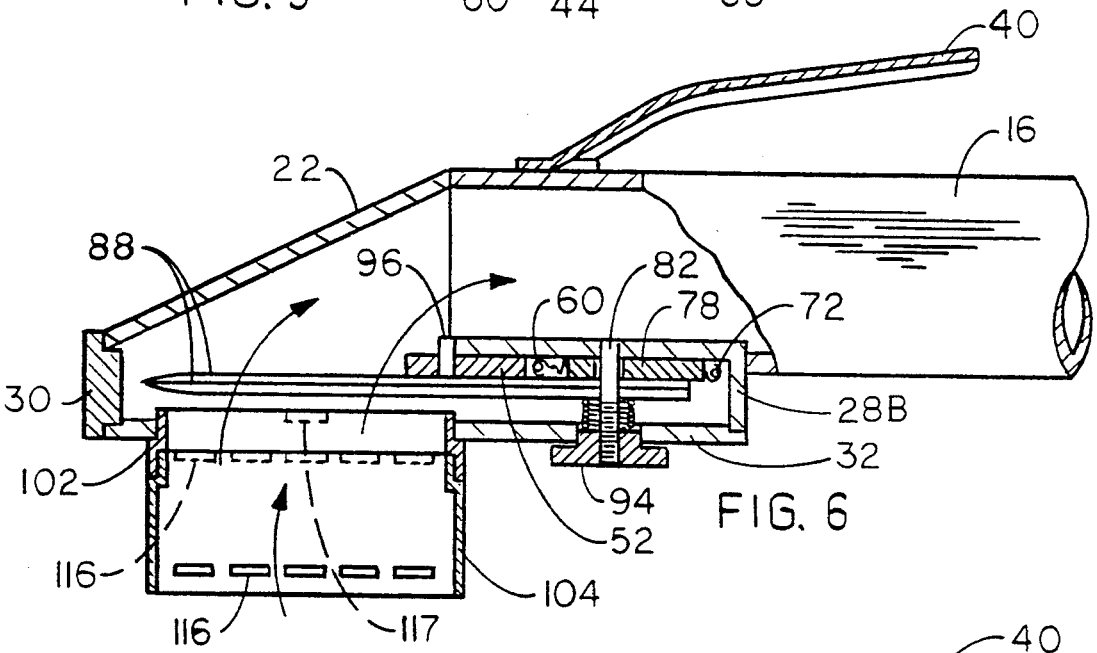
FIG. 6 is a view similar to FIG. 2, to more particularly show a spacer member of a different dimension than that shown in FIG. 2 for cutting shorter lengths of hair.
Figure 7:
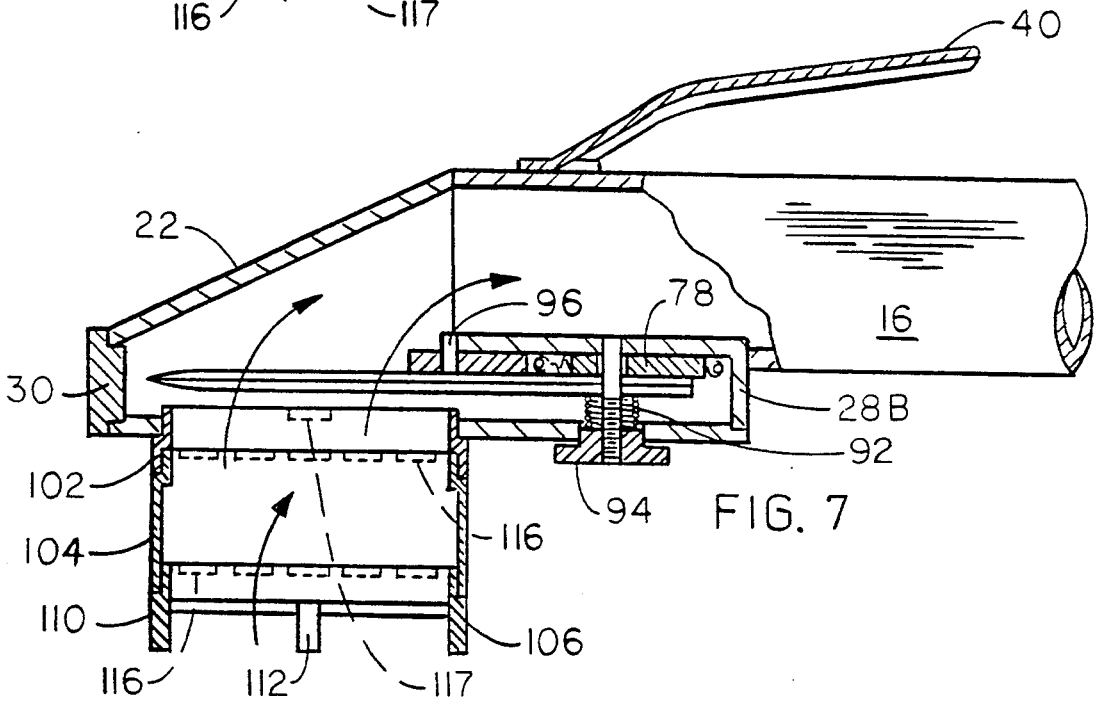
FIG. 7 is a view similar to FIG. 6 and shows the spacer member of FIG. 2 combined with the spacer member of FIG. 6.

Bottom wall 32 has a rectangular shaped opening 34 to accommodate a spacer member 102 which, as will be described hereinafter determines the length of hair to be cut from a subject's head. A second spacer member 104 is configured to fit or snap into the spacer member 102 (FIG. 6) and serves to further reduce the length of hair to be cut. A third spacer member 106 may be utilized and fits within second spacer member 104 as better seen in FIG. 7. Spacer member 106 has a pair of ribs 108 which extend between end pieces 110, and tabs 112 are provided intermediate the end pieces. The upper edges (as seen in FIG. 4) of end pieces 110 and that of tabs 112 engage the head of a subject in the manner seen in FIG. 1. Air inlet opening 116 are provided in the side walls of spacer members 102 & 104 and each has a detent 117 whereby spacer member 102 is secured to housing 20 or in the case of spacer member 104, secures the latter to spacer member 102. Housing 20 and the walls thereof are preferably made of clear plastic so that the interior of housing 20 may be seen by a user.

Figure 2:
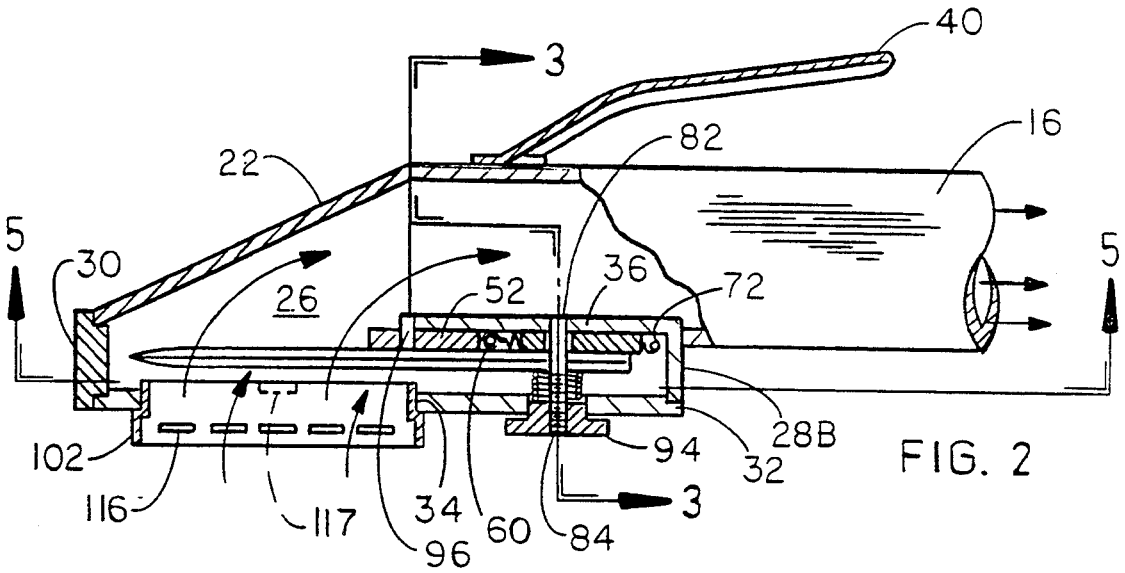
FIG. 2 is a view, partly in section, of the haircutting appliance of FIG. 1, more particularly showing the interior of the housing.
Figure 5:
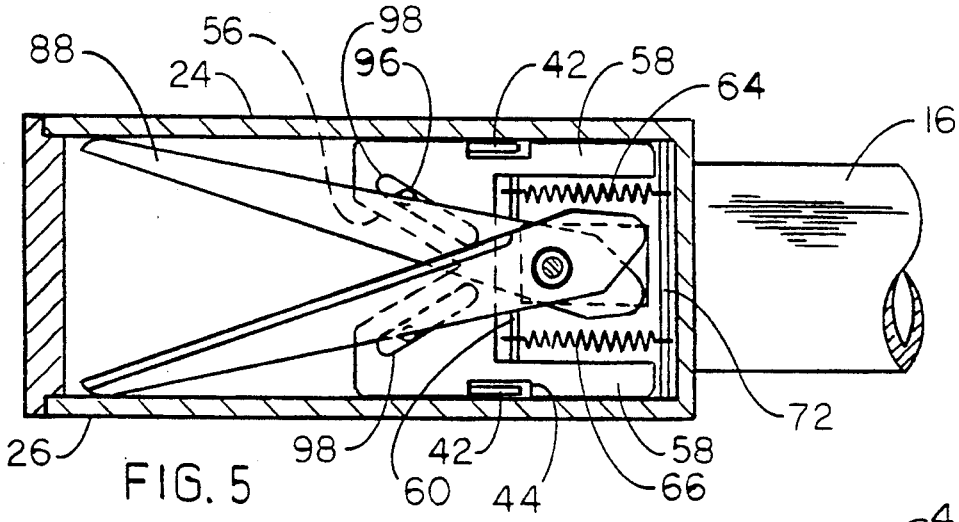
FIG. 5 is a view looking at the underside of the haircutting appliance to particularly show the cooperation of the scissor blades with the motion transmitting mechanism.

Coming now to the operation of appliance 12 thus far described, a user first attached the hose 18 to the handle 16 and grips handle 16 to manipulate it to a position in regard to the subject's head 14 as seen in FIG. 1. Spacer member 106 only, is shown in FIG. 1, without the cooperating spacer members 102 & 104 as disclosed in FIG. 7, in order to show that member 106 can be used alone in the operation of the appliance and without member 102 & 104, and further for drawing simplification purposes. Finger depressible member 40 is located on the hand 16 so that it is in juxtaposition with the user's hand (not shown) whereby one of the fingers, a thumb or other finger, of the user's hand can depress the member 40, thereby permitting one hand of the user to manipulate housing 20 with respect to the user's head while one finger of the same hand may be utilized to actuate member 40. This is of importance in that a user may operate appliance 12 with one hand and have the other hand for other purposes in connection with the cutting of hair. With suction applied through handle 16 a flow of air is created throughout the appliance 12, as represented by the arrows shown in FIGS. 2, 6 & 8. If, as seen in FIG. 2, only spacer member 102 is used and the lower edges of spacer member 102 rest on the subject's head, air will flow through along the scalp of the subject's head as well as openings 116, the latter enhancing the flow of air through the appliance. It will be understood that the slanted configuration of the top wall 22 enhances the flow of air through opening 34 in that the transverse cross sectional area of the housing 20 is significantly less than the transverse cross sectional area adjacent end wall 28 whereby the velocity of air entering opening 34 is enhanced by the difference in cross sectional areas. The suction which is created causes the longer hairs to be sucked up through opening 34 and in the path of movement of scissor blades 88. When the user observes the long hairs through the clear walls of housing 20, the user will manipulate the finger which rests on member 40 to depress the latter. Legs 42 of member 40 thus will be pivoted within the housing to contact the edges of the recess 54 of plate 52 which for example, is in the position shown in FIG. 5. Plate 52 as indicated herein before is normally urged by springs 64 & 66 in a direction towards wall portion 28-B so that when legs 42 are pivoted, plate 52 will be displaced in a direction away from wall portion 28-B and against the bias of springs 64 & 66. Studs 96, on scissor blades 88, are disposed in the ends of cam slots 98 which are remote frame legs 58 when plate 52 is urged in a direction towards wall portion 28-B by the springs 64, 66. When plate 52 is moved towards wall 30, studs 96 ride within slots 98 and move towards each other, carrying the scissor blades 88 with them to cut hair which lie in a path between the blades. It will be understood that notch 56 is provided in plate 52 so that the latter will not interfere with respect to the hair being cut. When the user has completed the desired cutting of hair, the user's finger is released from member 40 and the different parts of motion transmitting mechanism 50 are returned by springs 64 & 66 to the position shown in FIG. 5 and member 40 returns to its upright position. The hairs cut within housing 20 then flow out through handle 16 into hose 18 for collection in the vacuum cleaner, not shown. As will be apparent and well understood by those skilled in the art, spacer members 102, 104 and 106 determine the length of the cut hair in so far as the spacer members position the scissor blades 88 a certain distance in respect to the scalp of the user. Obviously, the further the scalp is from the point where the scissor blades come together to cut the hair the shorter the length of hair that is cut off, and conversely, the closer the scalp to the scissor blades the longer the hair is cut off. Thus, in considering the utilization of spacer members in FIGS. 2, 6 & 7, the length of hair cut off with the structure shown in FIG. 2 will become progressively less with that of spacers in FIG. 6 and finally that of FIG. 7.

As further shown in FIG. 4, end wall 30 is removable and serves to gain access to the interior of housing 20 for several purposes one of which may be to clean out such housing. Obviously, knurled head 94 may be unthreaded so that the bottom wall 30 may be removed, if access to the scissor blades 88, or other parts of the motion transmitting mechanism 50 is desired.

As indicated hereinabove an important advantage of the haircutting appliance of the present invention is the utilization of a haircutting appliance by using only one hand, thereby permitting freedom of use of the other hand, to use a comb or mirror or the like if the user is cutting his or her own hair. A further advantage of the use of a mechanical motion transmitting mechanism or drive, is the avoidance of expensive electric power drives to actuate the scissor blades. This permits the manufacturer to avoid the necessity of obtaining the approval of Underwriters Laboratories (UL) which is almost mandatory if the sale of an electrical appliance is to be made through the usual sales outlets. Furthermore, professionals and others who cut hair generally desire the use of a pair of scissors which is intermittently operated rather than a continuously operated motor driven shearing means. In addition, the motion transmitting mechanism has a small number of simple and inexpensive parts, and the mechanical nature thereof, gives the user a "positive feel" or feedback, in feeling and sensing the actual cutting of hair which is comparable to cutting hair with a hand held pair of scissors.

Figure 10:
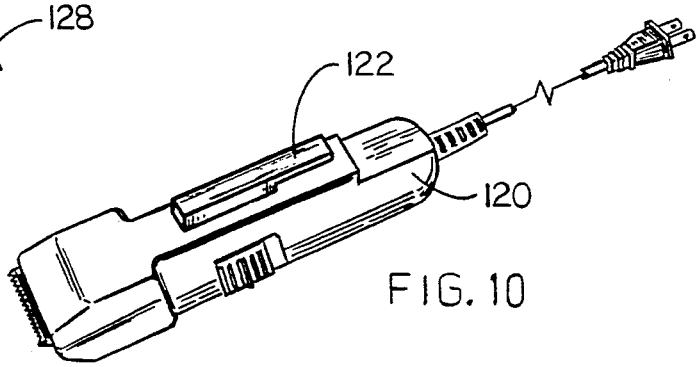
FIG. 10 is a perspective view of the electric hair clipper shown in FIG. 8.
Figure 11:
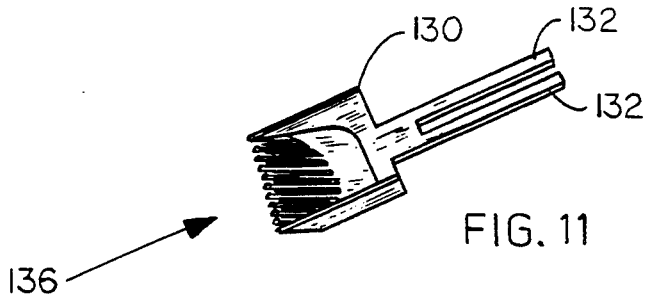
FIG. 11 is a perspective view of an adjustable hair spacer member usable with the hair clipper of FIGS. 8 & 10.

The structure of the haircutting appliance 12 lends itself to utilization of an electric hair clipper which in the normal barbering process completes the cutting or trimming of the short hairs along the neck line or adjacent areas. To this end, an electric hair clipper 120 is shown in FIGS. 8 & 10 and is provided with a gripping latch member 122 on the top thereof.

Figure 8:
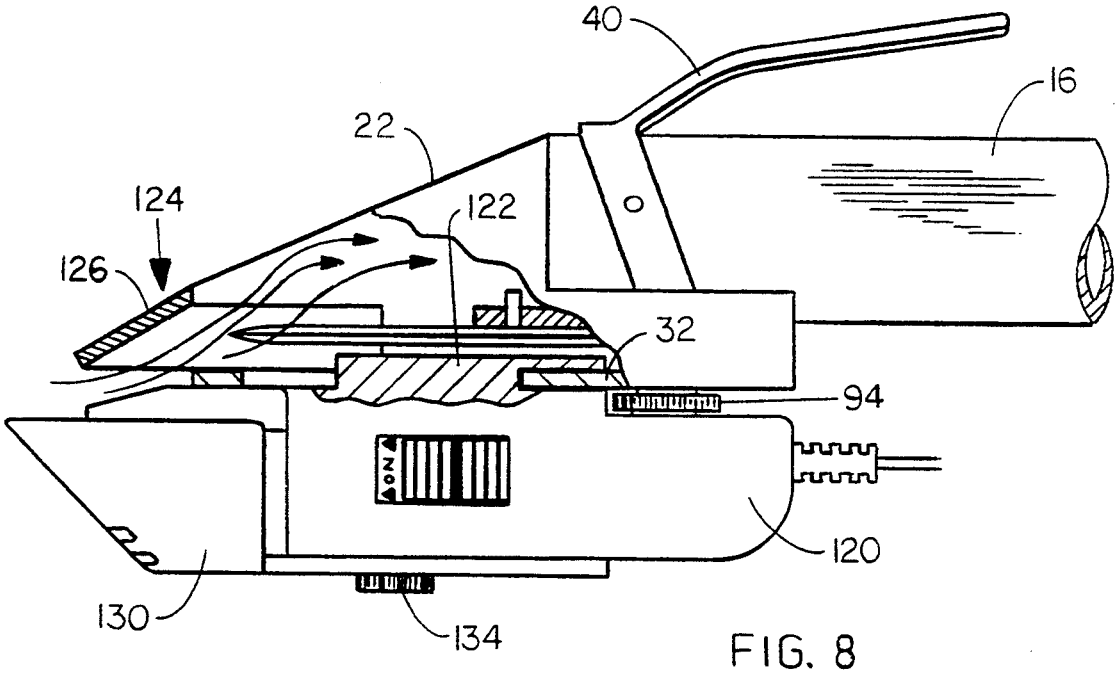
FIG. 8 is a view, partly in section, showing the attachment of an electric hair clipper to the haircutting appliance of FIG. 1.
Figure 9:
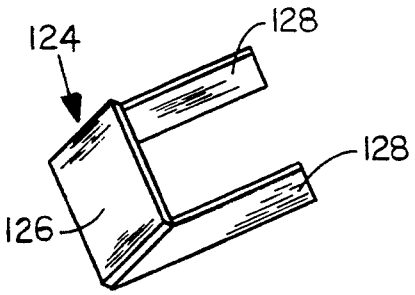
FIG. 9 is a perspective view of an air deflecting member usable with the hair clipper shown in FIG. 8.

Latch member 122 secures clipper 120 to the bottom wall 32 of housing 20 and projects through opening 34 to grip a portion of the wall surface surrounding opening 34, as seen in FIG. 8.

In utilizing clipper 120, end wall 30 is removed and in its place is substituted air flow directing member 124 having an inclined surface 126 and a pair of resilient arms 128 which snap in place on the side walls of compartment 22 to hold member 124 in place. Electric clipper 120 carries a conventional hair spacer guide 130 which has a pair of spaced fingers 132 which cooperate with a knurled threaded nut 134 to position the teeth 136 of guide 130 with respect to the cutting head of clipper 120 to selectively vary the length of hairs cut by clipper 120.

In the use of clipper 120, a user grips the handle 16 of the appliance 12 an manipulates the appliance with attached clipper 120 to trim the short hairs. Obviously, in this usage, the scissor blades 88 are not utilized and finger depressible member 40 is not depressed or actuated. The hair cut by clipper 120 is carried by the air flowing into housing 20, as represented by the arrows of FIG. 8. With the clipper 120, a user has all the equipment on had to complete the entire barbering process of cutting long hairs and trimming of the short hairs to provide a practical and effective haircutting appliance.

While a preferred embodiment of the invention has been described, modifications can be made and devised without departing from the spirit of the invention and the scope of the appended claims.

What is claimed is:

1. A haircutting appliance for connection to a vacuum source to carry away cut hairs comprising, an enclosed housing having a first opening to a vacuum source and having a second opening permitting entry of hair to be cut therein, a pair of moveable shear members operably disposed within the housing for cutting hair upon movement thereof, a handle extending from said housing to be held by a hand of a user of the appliance for cutting hair, finger depressible means including a member pivotally mounted on an exterior portion of said housing and having at least one leg projecting into said housing, said pivotal member being in juxtaposition to said handle for operation by the same hand of the user holding said handle to operate the appliance and, a motion transmitting mechanism interconnecting said shear members and said at least one leg of the finger depressible member for imparting motion of said finger depressible means to said shear members, said motion transmitting mechanism including a plate engaged by said at least one leg and supported for sliding movement such that said plate is moved in one direction by movement of the at least one leg of said member of the finger depressible means to operate the shear members to cut hair entering said housing, and spring means connected to said plate to normally urge said plate in an opposite direction.

2. The haircutting appliance of claim 1 wherein at least one recess is formed in the plate and engages an end of said at least one leg of said member projecting into the housing.

3. The haircutting appliance of claim 2 wherein the shear members constitute a pair of pivotally mounted scissor blades each having a stud projecting therefrom, and said plate having camming means which engage said studs upon said sliding movement of said plate to thereby move said blades towards and away from each other.

4. The haircutting appliance of claim 3 wherein the camming means are a pair of angled slots in which the scissor blades studs rise.

5. The haircutting appliance of claim 4, wherein the plate has a pair of legs at one end supporting a first rod, and a second rod is provided in said housing in juxtaposition to said first rod, wherein said spring means includes at least one coil spring which has one end connected to said first rod and another end connected to said second rod to urge said plate in said opposite direction toward said second rod.

6. The haircutting appliance of claim 5 wherein the angled slots converge in a direction towards said one end of said plate.

7. An appliance for cutting and carrying away hairs of a subject's head, comprising a housing adapted for connection to a vacuum source, said housing having a top wall and a pair of depending side walls closed off by a bottom wall, said bottom wall having a first opening therein permitting entry into said housing of said hairs of said subject, said housing further having a pair of oppositely disposed end walls, one of said end walls having a second opening for connection to the vacuum source and the other end wall being removable to permit entry into said housing, said top wall having a slanting configuration wherein the distance from the top wall to the bottom wall is greatest adjacent said one end wall and least adjacent said other end wall to effect increased velocity of air entering the first opening in said bottom wall, a hollow handle on said housing having one end connected to said end wall of the housing at said second opening and the other end connected to the vacuum source, a finger depressible member pivotally mounted on said handle outside said housing and have at least one leg projecting into said housing, said finger depressible member being located adjacent to said housing enabling a same hand of a user holding the handle to also operate the finger depressible member, a pair of scissor blades pivotally mounted in said housing, a slidable plate supported for sliding movement in said housing operably connected to the at least one leg of the finger depressible member, said slidable plate having camming means for actuating said scissor blades upon movement of said slidable plate, and spacer means carried by the bottom wall of the housing and extending from said first opening to space the scissor blades a predetermined distance from the subject's head.

8. The haircutting appliance of claim 7 wherein the spacer means are provided with passageways to permit entry of air between an end of the spacer means remote from the housing and the bottom wall of the housing.

* * * * *